US011718999B2

(12) United States Patent
Tooley et al.

(10) Patent No.: US 11,718,999 B2
(45) Date of Patent: Aug. 8, 2023

(54) GRAB RAIL

(71) Applicant: Norcros Group (Holdings) Limited, Hampshire (GB)

(72) Inventors: Jonathan Harry Tooley, Hampshire (GB); Willoughby Wilding-Taylor, Hampshire (GB)

(73) Assignee: Norcros Group (Holdings) Limited, Hampshire (GB)

( * ) Notice: Subject to any disclaimer, the term of this patent is extended or adjusted under 35 U.S.C. 154(b) by 0 days.

(21) Appl. No.: 17/152,618

(22) Filed: Jan. 19, 2021

(65) Prior Publication Data

US 2022/0228371 A1 Jul. 21, 2022

(30) Foreign Application Priority Data

Jan. 17, 2020 (GB) ..... 2000704

(51) Int. Cl.
*E04F 11/18* (2006.01)
*A47K 17/02* (2006.01)

(52) U.S. Cl.
CPC ..... *E04F 11/1808* (2013.01); *A47K 17/022* (2013.01); *E04F 2011/187* (2013.01)

(58) Field of Classification Search
CPC ..... E04F 11/1808; E04F 2011/187; A47K 17/022
USPC ..... 256/65.15
See application file for complete search history.

(56) References Cited

U.S. PATENT DOCUMENTS 4,895,332 A * 1/1990 Hansen ..... A47K 3/003 248/251
2009/0242864 A1* 10/2009 Carney ..... E04F 11/1808 256/65.05
2009/0308995 A1* 12/2009 Kuo ..... A47K 10/10 248/231.91
2011/0253854 A1* 10/2011 Garrels ..... A47K 17/022 29/525.01
2014/0097394 A1 4/2014 Hsieh et al.
2015/0014505 A1* 1/2015 Edwards ..... A47K 1/09 248/315
2020/0270869 A1* 8/2020 Chuang ..... F21V 23/0471
2022/0228371 A1* 7/2022 Tooley ..... A47K 17/022

FOREIGN PATENT DOCUMENTS

GB 2500020 A 9/2013
JP H07317262 A 12/1995
JP 2005282299 A 10/2005
WO 2017144842 A1 8/2017
WO 2020085620 A1 4/2020

* cited by examiner

*Primary Examiner* — Muhammad Ijaz
(74) *Attorney, Agent, or Firm* — Dinsmore & Shohl LLP

(57) ABSTRACT

A grab rail has an elongate shaft and attachment fittings to attach the shaft to a wall. The attachment fittings are configured with at least two connections that are selectively engageable with the elongate shaft to enable the spacing between contact surfaces on the attachment fittings to be varied.

11 Claims, 1 Drawing Sheet

GRAB RAIL

FIELD OF THE INVENTION

This invention relates to a grab rail of the type typically mounted beside bathrooms to assist bathroom users.

BACKGROUND OF THE INVENTION

The use of grab rails, particularly in bathrooms, is well established, one example of such a rail being described in our UK Patent No. 2500020. Typically a rail is mounted horizontally, vertically or at an angle between, on a wall surface. Where the wall is a stud wall, the rail should be fixed to studs. This does not present a problem if the rail is to be mounted vertically as opposite ends of the rail can be fixed to vertically spaced sites on a common stud. However, because of variations in stud spacings and/or the need to accommodate different mounting angles, rails of differing lengths must be provided or the rail cut to length prior to application. The former presents inventory issues while the latter can present issues arising from the need to form new connections between the rail and its mountings.

It is an object of the invention to provide a grab rail that will go at least some way in addressing the aforementioned problems; or which will at least provide a novel and useful alternative.

SUMMARY OF THE INVENTION

In one embodiment, a system including a processing device . . . In one aspect the invention provides a grab rail comprising an elongate shaft having a length axis; and a pair of attachment fittings engageable with said elongate shaft at spaced points along said length axis, said attachment fittings having contact surfaces offset from said length axis which, in use, engage a support surface at spaced points with respect to said length axis, wherein at least one of said attachment fittings has at least two connections each of which is selectively engageable with said shaft and wherein said at least one of said attachment fittings is further configured whereby the distance between said contact surfaces can be varied by selection of the connection between said at least one attachment fitting and said shaft.

Preferably said shaft and said length axis are linear.

Preferably said at least one attachment fitting comprises a mounting which, when the attachment fitting is engaged with said shaft, is aligned with said length axis; and a pillar extending from said mounting, a distal end of said pillar defining or being connected to a said contact surface.

Preferably said mounting has opposed ends and a mid-length, said pillar extending from said mounting at a position between said opposed ends but offset from said mid-length, and wherein said opposed ends define said at least two connections.

Preferably each of said attachment fittings is the same.

Preferably said attachment fittings are engaged with opposed ends of said elongate shaft.

Preferably said elongate shaft comprises a plurality of shaft modules mounted in series on a common connecting bar, Preferably said attachment fittings are mounted to said common connecting bar.

Many variations in the way the present invention can be performed will present themselves to those skilled in the art. The description which follows is intended as an illustration only of one means of performing the invention and the lack of description of variants or equivalents should not be regarded as limiting. Subject to the scope of the appended claims, wherever possible, a description of a specific element should be deemed to include any and all equivalents thereof whether in existence now or in the future.

BRIEF DESCRIPTION OF THE DRAWINGS

The invention will now be described with reference to the accompanying drawing in which.

DETAILED DESCRIPTION OF WORKING EMBODIMENT

Figure 1:
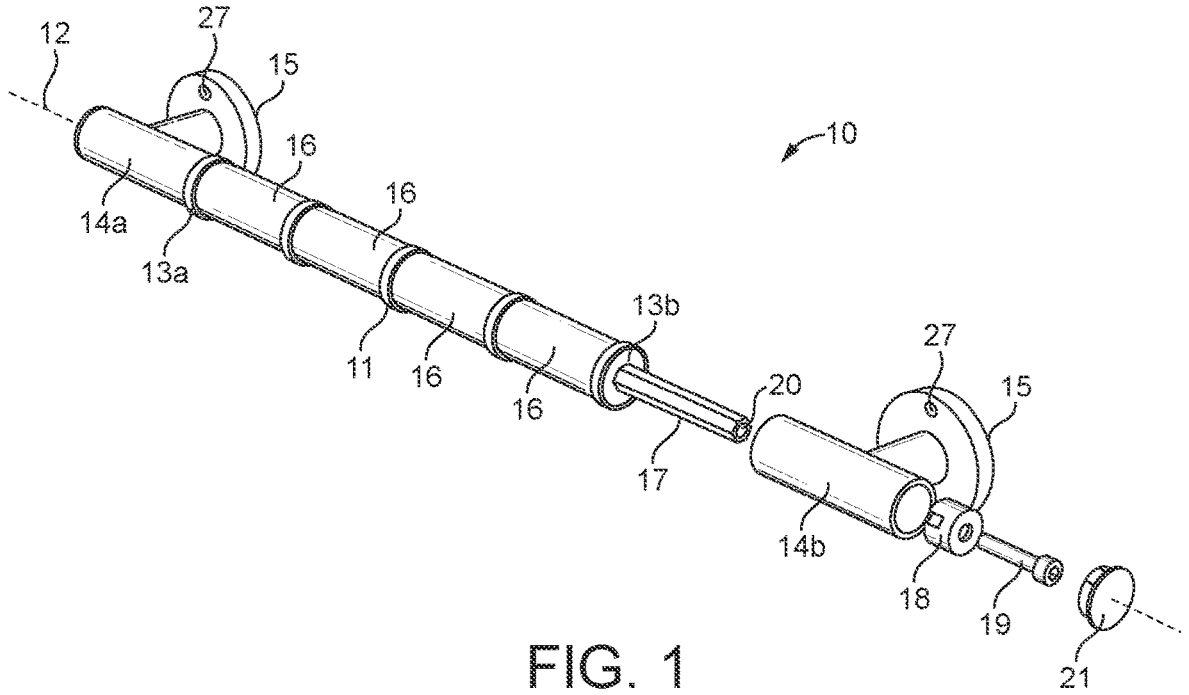
FIG. 1: shows an isometric view from the front, partly exploded, of a grab rail to which the invention may be applied.
Figure 2:
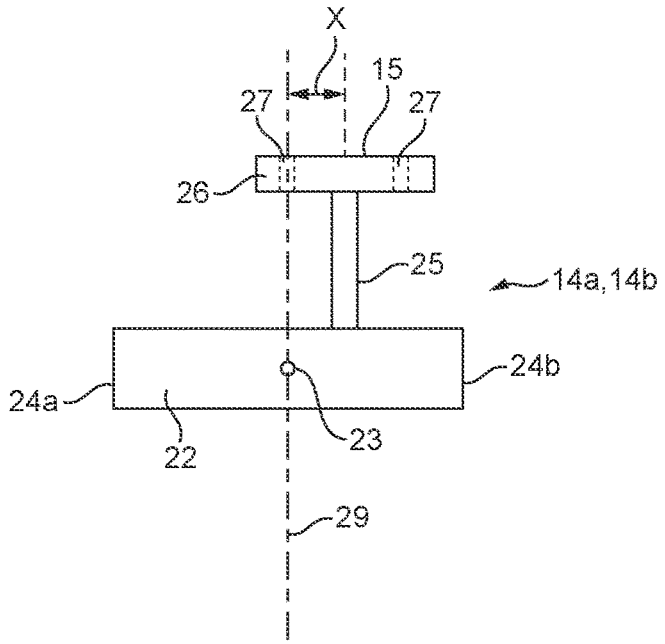
FIG. 2: shows an enlarged plan view of part of that which is shown in FIG. 1.

Referring to FIGS. 1 & 2, a grab rail 10 is shown comprising an elongate shaft 11 having a length axis 12 and opposed ends 13*a* and 13*b*. Attachment fittings 14*a* and 14*b* are engaged with respective shaft ends 13*a* and 13*b* to mount the shaft 11 to, but spaced from, a mounting surface such as a stud wall (not shown). In the conventional manner the attachment fittings include contact surfaces 15 which contact the wall and are spaced from one another relative to the axis 12.

Those skilled in the art will know that it is preferable, and in many instances essential, that the contact surfaces overlie stud positions in a stud wall and it is an important feature of the invention that the spacing between the contact surfaces 15 can be varied so that the rail 10 can be readily adapted for fitment to walls in which the studs are spaced at different centres. As described in greater detail below, this is achieved by suitably configuring at least one, and preferably both, of the attachment fittings and further adapting the fitting or fittings for selective engagement with the shaft ends 13*a* and 13*b*.

As described in our British Patent GB 2500020, the shaft 11 may be formed as a series of shaft modules 16 mounted on, and clamped together by, a central connecting bar 17. The connecting bar 17 preferably extends beyond the shaft ends 13*a*, 13*b* to engage with and form mounts for the attachment fittings 14*a*, 14*b*. In the example shown, the attachment fittings 14*a*, 14*b* are fixed to the connecting bar 17 by means of clamping inserts 18 that locate within the brackets 13, and locking screws 19, the locking screws engaging in internally threaded axial bores 20 in the ends of the connecting bar 17. With the attachment fittings 14 clamped to the handle 10, end caps 21 may be fixed to the exposed ends of the attachment fittings 14.

As described above, the invention has been devised with the specific object of providing a single grab rail assembly that can accommodate a range of spacings between mounting points. This accommodation is provided by the assembly so that the spacing between the contact surfaces can be selectively varied.

In the form shown each attachment fitting includes a mounting, preferably a tubular mounting 22 that, when the attachment fitting is connected to the shaft 11, is aligned along the shaft axis 12. The tubular mounting has a mid-position 23 and opposed ends 24*a* & 24*b*, the ends 24*a* & 24*b* preferably being identical in form. It can be seen that a pillar 25 projects from the outer surface of the mounting tube, the distal end of the pillar 25 mounting a fixing base 26 the underside of which, in turn, defines or carries contact surface 15. The fixing base typically includes apertures 27 though which fixing screws may be passed to attach the rail to a wall.

In the example shown the pillar 25 is linear, is mounted perpendicular to the tube 22 but is offset by x from a line 29, parallel to the pillar and passing through the mid-length of the tube 26. Since each of tube ends 28*a* & 28*b* is selectively engageable with the handle shaft 11, it will be appreciated that, by selecting which of the ends is chosen to engage the handle, the spacing between the contact surfaces may be varied.

It will thus be appreciated that the invention provides a simple yet effective means of providing a grab rail in which selective assembly of the rail components allows the rail to be readily and effectively mounted on studs of different spacings.

What is claimed is:

1. A grab rail comprising:

a shaft elongated in a longitudinal direction and having a pair of spaced apart longitudinal ends; and a pair of attachment fittings each configured to engage with the shaft at one of the longitudinal ends of the shaft;

wherein each attachment fitting includes:

a mounting having a first end and a second end opposite to the first end; and a pillar coupled to the mounting at a coupling portion between the first end and the second end, and wherein for at least one of the attachment fittings, a distance between the first end and the coupling portion is different than a distance between the second end and the coupling portion such that selectively engaging the first end or the second end with the respective longitudinal end of the shaft changes a distance between the pillars of the pair of attachment fittings.

2. The grab rail according to claim 1, wherein for each attachment fittings, the distance between the first end and the coupling portion is different than the distance between the second end and the coupling portion such that selectively engaging the first end or the second end with the respective longitudinal end of the shaft changes the distance between the pillars of the pair of attachment fittings.

3. The grab rail according to claim 1, wherein the shaft and the mountings are aligned on a length axis of the shaft.

4. The grab rail according to claim 1, wherein the each attachment fitting comprises a base defining a contact surface, wherein the pillar is coupled to the base.

5. The grab rail according to claim 4, wherein the base defines an aperture.

6. The grab rail according to claim 1, wherein the pair of the attachments each has an asymmetrical shape in the longitudinal direction.

7. The grab rail according to claim 1, wherein each of the attachment fittings is the same.

8. The grab rail according to claim 1, wherein the shaft comprises a plurality of shaft modules.

9. The grab rail according to claim 8, wherein the shaft modules are mounted in series on a common connecting bar.

10. The grab rail according to claim 9, wherein the attachment fittings are mounted to the common connecting bar.

11. A method for a grab rail comprising:

connecting a shaft elongated in a longitudinal direction and a pair of attachment fittings each configured to engage with the shaft at longitudinal ends of the shaft;

wherein each attachment fitting includes:

a mounting having a first end and a second end opposite to the first end; and a pillar coupled to the mounting at a coupling portion between the first end and the second end, and wherein for at least one of the attachment fittings, a distance between the first end and the coupling portion is different than a distance between the second end and the coupling portion; and selectively engaging the first end or the second end of each attachment fitting with the shaft so as to change a distance between the pillars of the attachment fittings.

* * * * *